United States Patent [19]

Oden et al.

[11] 4,175,954

[45] Nov. 27, 1979

[54] SELF-DISINTEGRATING RANEY METAL ALLOYS

[75] Inventors: Laurance L. Oden, Salem; James H. Russell, Corvallis, both of Oreg.

[73] Assignee: The United States of America as represented by the United States Department of Energy, Washington, D.C.

[21] Appl. No.: 927,235

[22] Filed: Jul. 24, 1978

[51] Int. Cl.[2] ..... C22C 21/00

[52] U.S. Cl. ..... 75/138; 75/0.5 R; 75/139; 75/170; 148/3; 148/13; 148/32; 252/477 Q

[58] Field of Search ..... 75/138, 170, 139, 0.5 R; 252/477 Q; 148/3, 13, 32

[56] References Cited

U.S. PATENT DOCUMENTS 3,627,790 12/1971 Stiles ..... 252/477 Q

*Primary Examiner*—R. Dean

*Attorney, Agent, or Firm*—Dean E. Carlson; Judson R. Hightower

[57] ABSTRACT

A method of preparing a Raney metal alloy which is capable of self-disintegrating when contacted with water vapor. The self-disintegrating property is imparted to the alloy by incorporating into the alloy from 0.4 to 0.8 weight percent carbon. The alloy is useful in forming powder which can be converted to a Raney metal catalyst with increased surface area and catalytic activity.

11 Claims, 2 Drawing Figures

SELF-DISINTEGRATING RANEY METAL ALLOYS

BACKGROUND OF THE INVENTION

This invention is a result, in part, of federally sponsored research activities by the U.S. Department of Energy.

In coal gasification processes an important step in the production of a high BTU gas is the reaction of carbon monoxide with hydrogen in the presence of a catalyst to produce methane. The catalyst normally used to promote the methane-producing reaction is a nickel catalyst known as Raney nickel. As described in U.S. Pat. No. 1,628,190 to M. Raney, the Raney nickel catalyst is produced by forming a catalyst precursor which is an alloy of nickel and aluminum, leaching the resulting alloy with a sodium hydroxide solution or other suitable caustic solvent to remove the aluminum, leaving an activated nickel. Other Raney metal catalysts may be prepared from alloys containing aluminum in binary combination with cobalt, manganese, iron, copper, or silver by leaching aluminum from the Raney metal alloys with a caustic solvent. When preparing Raney metal catalysts, the caustic solvent is normally contacted with the powder form of the Raney metal alloy. Conventional means for obtaining the Raney metal alloy as a powder include mechanically grinding a cast alloy or shattering the alloy by dropping molten alloy into water.

U.S. Pat. No. 3,809,658, to Csuros et al. discloses a process for preparing Raney metal catalysts of high catalytic activity in which the starting material is a mechanically ground alloy. The ground alloy is leached with a caustic solvent under conditions of fast, turbulent flow.

U.S. Pat. No. 3,939,011 to Larson teaches that small particles of Raney metal alloy can be produced by pouring a molten Raney metal alloy material through a flowing stream of water. These particles can then be leached with the caustic solvent or mechanically ground to a smaller size prior to leaching.

It is desirable to prepare Raney metal catalysts without having to utilize the conventional grinding apparatus because of the expense of the process and the apparatus and the problems accompanying the operation of the apparatus.

Accordingly, it is a primary object of this invention to provide a method of making a Raney metal alloy which self-disintegrates when contacted with water vapor to form a Raney metal alloy powder.

It is another object of this invention to provide a method of making a Raney metal alloy powder.

Another object of this invention is to provide a Raney metal alloy which self-disintegrates when contacted with water vapor to form a Raney metal alloy powder.

It is still another object of this invention to provide a Raney metal alloy powder.

It is yet another object of this invention to provide a method of making a Raney metal catalyst.

An additional object of this invention is to provide a Raney metal catalyst.

These and other objects and advantages of this invention will become apparent when the following detailed description of the preferred embodiments are considered with the drawings.

SUMMARY OF THE INVENTION

The invention relates generally to a Raney metal alloy which is capable of self-disintegrating when contacted with water vapor to form a powder. The term "self-disintegrating," as used here and throughout this specification, is intended to mean disintegration, or breaking-up, without the aid of any type of mechanical apparatus. More specifically, the present invention is directed to the incorporation of from 0.4 to 0.8 weight percent carbon in a conventional Raney nickel alloy which contains from 49 to 70 weight percent aluminum. Other catalytically active metals such as cobalt, manganese, iron, copper, and silver, which are also prepared as Raney alloys in combination with aluminum, may be used in forming the self-disintegrating Raney metal alloy of the present invention. The carbon is incorporated into the Raney metal alloy by melting. In order to improve the self-disintegrating properties of the resulting Raney metal alloy, the solid carbon-containing Raney metal alloy may be heat-treated.

The preferred Raney metal alloy of the invention can include either three or four phases. In the event the alloy is not heat-treated after solidification, the alloy includes an aluminum carbide phase, a $Ni_2Al_3$ phase, a $NiAl_3$ phase and a Al-$NiAl_3$ eutectic phase. If the solid alloy is heat-treated, the alloy includes only an aluminum carbide phase, a $Ni_2Al_3$ phase and a $NiAl_3$ phase.

The invention also includes the disintegrated Raney metal alloy powder which is obtained by reacting the alloy with water vapor which hydrolyzes the aluminum carbide phase and causes the disintegration of the alloy. The alloy powder is useful in preparing a Raney metal catalyst by leaching the aluminum metal from the alloy with a caustic solvent.

Although the invention will be described in connection with preferred embodiments considered with the drawings, it will be understood that it is not intended to limit the invention to those embodiments. On the contrary, it is intended to cover all alternatives, modifications and equivalents as may be included within the spirit and scope of the invention as defined by the appended claims.

DESCRIPTION OF THE PREFERRED EMBODIMENTS

In accordance with the invention a Raney metal alloy is prepared which contains from 0.4 to 0.8 weight percent carbon and which self-disintegrates when contacted with water vapor. The carbon is advantageously prealloyed with the catalytically-active metal. Aluminum is then added to the molten mixture in an amount of from 49 to 70 weight percent with the preferred amount being from 49 to 60 weight percent. Preferably, the catalytically-active metal present in the mixture is nickel, but the method is also applicable to cobalt, manganese, iron, copper, and silver, which are conventionally prepared as Raney metal alloys in the prior art. A less satisfactory alternative to prealloying the carbon and the catalytically-active metal is to add the carbon directly to the mixture of catalytically-active metal and aluminum.

The alloying of the carbon with the catalytically-active metal directly or in combination with aluminum can be accomplished in any conventional manner such as be mixing the component materials together, heating the mixture until molten, and cooling the mixture in a suitable mold to form a solid.

In addition to the carbon, catalytically-active metal, and aluminum present in the initial alloy mixture of the invention, there may be incorporated into the mixture minor additions of metals which promote activity or improve selectivity. Examples of such additive metals are chromium, molybdenum, calcium, barium, thorium, and vanadium.

Figure 1:
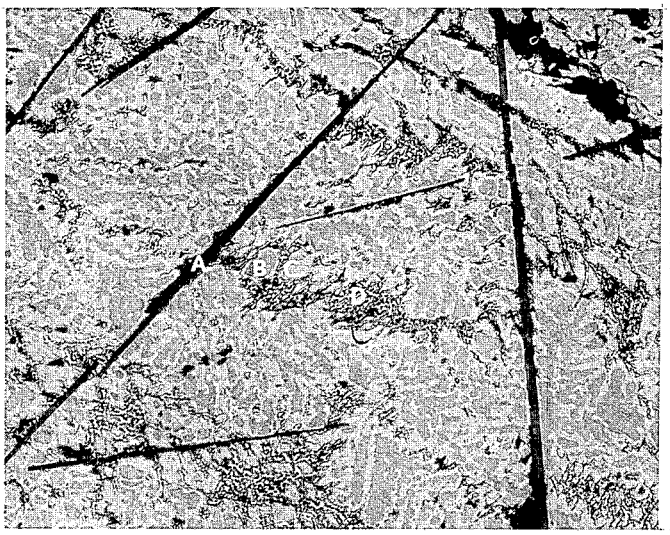
FIG. 1 shows in cross-section and magnified 200 times the various phases present in a Raney nickel alloy prepared in accordance with one embodiment of the invention.

If the Raney metal alloy contains the preferred carbon, nickel, and aluminum, the resulting alloy includes four phases as depicted in FIG. 1 which shows a cross-section of an alloy containing 0.8 weight percent carbon, 49.6 weight percent nickel, and 49.6 weight percent aluminum. Phase A is an aluminum carbide phase present as thin flat platelets and is believed to be $Al_4C_3$; phase B is $Ni_2Al_3$; phase C is $NiAl_3$; and phase D is a Al-$NiAl_3$ eutectic.

After solidification of the molten mixture of carbon, catalytically-active metal, and aluminum, the resulting solid Raney metal alloy is capable of self-disintegrating when contacted with water vapor. If self-disintegration is not desired, either because the alloy is to be stored or transported, the alloy should be sealed in a container to prevent contact with water or atmospheric water vapor. If self-disintegration is desired, the alloy is contacted with atmospheric water vapor. The water vapor reacts with the carbide phase by hydrolysis, causing the carbide phase to expand and liberating the carbon as a volatile hydrocarbon. The expansion of the carbide phase causes the solid Raney metal alloy to crack and disintegrate into a powder. This disintegration normally occurs within 30 days at room temperature and this time can be reduced by approximately 30 percent by keeping the alloy at a temperature of approximately 100° C. while in contact with the water source. The disintegration reaction can be halted at any time by isolating the alloy from the water source.

Figure 2:
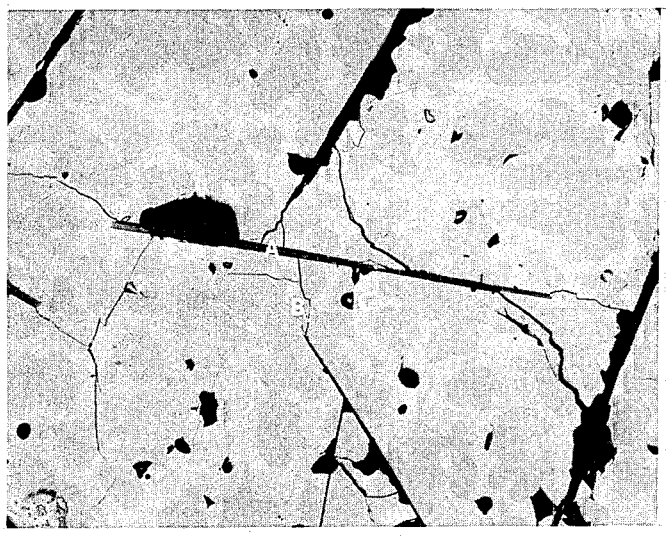
FIG. 2 shows in cross-section and magnified 200 times the various phases present in a Raney nickel alloy prepared in accordance with another embodiment of the invention.

Instead of disintegrating the Raney metal alloy having the four phase structure obtained after solidification by contact with water or its vapor, it has been found that a more rapid disintegration can be obtained if the solidified Raney metal alloy is first heat-treated. In accordance with this embodiment of the invention, the solid Raney metal alloy resulting from cooling the molten mixture of carbon, catalytically-active metal, and aluminum is heated to a temperature in the range of from 600° C. to 854° C. for at least two hours. This heat treatment results in the elimination of the eutectic phase from the alloy as depicted in FIG. 2 which shows a cross section of an alloy containing 0.8 weight percent carbon, 49.6 weight percent nickel, and 49.6 weight percent aluminum which has been heat-treated. Phase A is $Al_4C_3$; phase B is $Ni_2Al_3$; and phase C is $NiAl_3$. Small cracks are created in the alloy during the heat treatment which ultimately aid in the self-disintegration reaction and can be seen in FIG. 2 originating at the $Al_4C_3$ platelets.

In order to cause the heat-treated Raney metal alloy to self-disintegrate to form a powder, the alloy is contacted with water or atmospheric water vapor and the disintegration occurs within 10 days at room temperature as compared to the 30 days necessary to disintegrate the alloy which has not been heat-treated. This 10 day period can be shortened by approximately 30 percent by keeping the alloy at a temperature of approximately 100° C. while in contact with the water source.

The self-disintegration of both the Raney metal alloys which have and have not been subjected to heat treatment into Raney metal powder eliminates the conventional step of mechanically grinding the alloy to a powder. The Raney metal alloy powder obtained in accordance with the process of the present invention can be processed further in the conventional manner to form a Raney metal catalyst. However, the use of the Raney metal powder of the present invention results in a catalyst having a higher specific surface area and having a greater catalytic activity in the conversion of carbon monoxide and hydrogen to methane than the Raney metal catalysts prepared by prior art techniques.

To prepare a Raney metal catalyst from the alloy powder of the present invention, the powder is treated with a suitable caustic solvent to leach the aluminum from the alloy powder to obtain a catalytically-active metal powder. The preferred solvent is sodium hydroxide combined with water to form solutions containing from 1.0 to 5.0 weight percent NaOH. The powder should be treated for a time sufficient to ensure that most of the aluminum is removed from the powder, normally from 2 to 4 hours. After the leaching of the aluminum from the alloy, the catalyst is washed thoroughly with water and may optionally be passivated in a weak solution of $H_2O_2$ according to conventional practice.

Further details of the methods and compositions of the invention are set forth in the following illustrative examples:

EXAMPLE I

Fifty grams of nickel were alloyed with 0.604 g of finely divided carbon by arc-melting using a conventional non-consumable electrode process. The resulting ingot of alloy was remelted in the same furnace and 50 g of aluminum was added to the molten mixture. The mixture was allowed to solidify, resulting in a ternary alloy comprising 49.7 weight percent aluminum, 49.7 weight percent nickel and 0.6 weight percent carbon. The cooled ingot was cut in half and one half of the ingot was contacted with the atmosphere and one half of the ingot was encapsulated in an evacuated fused silica ampoule and heat-treated for 4 hours at 830° C. The encapsulated alloy was cooled to room temperature, the ampoule was broken, and the alloy was contacted with the atmosphere. The heat treated alloy self-disintegrated into a powder in about two weeks, whereas the alloy that was not heat treated required about 30 days.

The alloy powders obtained were than treated in a boiling 2 weight percent NaOH solution for four hours, rinsed thoroughly with water, and passivated in a 1 volume percent $H_2O_2$ solution.

Surface area measurements of the resulting Raney nickel catalyst were made using the apparatus described by Laurance L. Oden and James H. Russell in Bureau of Mines Report of Investigations No. 8272, 1978, page 7. The total surface area of the alloy powder, measured by nitrogen adsorption was 44 $m^2/g$; and the active nickel surface area, measured by hydrogen chemisorption, was 25 $m^2/g$. Conventional Raney nickel catalysts have surface areas of approximately three-fourths these values as determined by the same methods.

The methanation activity of the Raney nickel catalyst was also measured and determined to be 4.6 cc $CH_4$ (STP) per gram of catalyst per second at 360° C. This compares with a value of 3.3 cc $CH_4$ (STP) per gram of catalyst per second for conventional Raney nickel catalysts.

EXAMPLE II

A ternary alloy of 49.7 weight percent aluminum, 49.7 weight percent nickel, and 0.6 weight percent carbon was prepared as in Example I. The ingot was cut in half and one half of the ingot was heat-treated in Example I. After this heat treatment, both halves of the ingot were contacted with air to cause self-disintegration, but the alloy was maintained at 100° C. during the entire self-disintegration. The heat-treated alloy required 6 days for self-disintegration to be complete, whereas the alloy that was not heat-treated required 20 days.

While there has been described in the foregoing what may be considered to be preferred embodiments of the invention, modifications may be made therein without departing from the teachings of the invention and it is intended to cover all such modifications as fall within the scope of the appended claims.

We claim:

1. A method of preparing a self-disintegrating Raney metal alloy comprising:

(a) heating a mixture which comprises from 29.2 to 50.6 weight percent of at least one catalytically-active metal selected from the group consisting of nickel, cobalt, manganese, iron, copper, and silver, from 0.4 to 0.8 weight percent carbon, and from 49 to 70 weight percent aluminum to form a molten mixture, and (b) cooling the molten mixture to form a solid.

2. A method of preparing a self-disintegrating Raney metal alloy as described in claim 1 wherein said catalytically-active metal is nickel.

3. A method of preparing a self-disintegrating Raney metal alloy as described in claim 1 wherein said solid is heat-treated at a temperature of from 600° C. to 854° C. for at least two hours.

4. A method of preparing a self-disintegrating Raney metal alloy as described in claim 3 wherein said catalytically-active metal is nickel.

5. A method of preparing a Raney metal alloy powder comprising:

(a) heating a mixture which comprises from 29.2 to 50.6 weight percent of at least one catalytically-active metal selected from the group consisting of nickel, cobalt, manganese, iron, copper, and silver, from 0.4 to 0.8 weight percent carbon, and from 49 to 70 weight percent aluminum to form a molten mixture;

(b) cooling the mixture to form a solid; and (c) contacting said solid with water vapor which reacts with the carbide phase within said solid to cause the carbide phase to hydrolyze which cracks and disintegrates the solid into a powder.

6. A method of preparing a Raney metal alloy powder as described in claim 7 wherein said catalytically-active metal is nickel.

7. A method of preparing a Raney metal alloy powder as described in claim 5 wherein said solid is heat-treated at a temperature of from 600° C. to 854° C. for at least two hours prior to contacting said solid with water vapor.

8. A method of preparing a Raney metal alloy powder as described in claim 7 wherein said solid is maintained at temperature of approximately 100° C. while in contact with the water vapor.

9. A method of preparing a Raney metal catalyst comprising:

(a) contacting the alloy powder prepared in accordance with claim 5 with a caustic solution to leach out the aluminum, and (b) rinsing the resulting Raney metal catalyst powder with water.

10. A self-disintegrating nickel-aluminum alloy comprising about 49.6 weight percent nickel, about 49.6 weight percent aluminum and about 0.8 weight percent carbon with the nickel, aluminum, and carbon being present in the alloy as an aluminum carbide phase, a $Ni_2Al_3$ phase, a $NiAl_3$ phase and a Al-$NiAl_3$ eutectic phase.

11. A self-disintegrating nickel-aluminum alloy comprising about 49.6 weight percent nickel, about 49.6 weight percent aluminum and about 0.8 weight percent carbon with the nickel, aluminum, and carbon being present in the alloy as an aluminum carbide phase, a $Ni_2Al_3$ phase and a $NiAl_3$ phase.

* * * * *